US005743412A

United States Patent [19]

Noble

[11] Patent Number: 5,743,412

[45] Date of Patent: Apr. 28, 1998

[54] MODULAR PARTS SUPPLY RACK

[75] Inventor: William L. Noble, Wolverine, Mich.

[73] Assignee: Chrysler Corporation, Auburn Hills, Mich.

[21] Appl. No.: 748,672

[22] Filed: Nov. 13, 1996

[51] Int. Cl.[6] ..... A47F 7/00

[52] U.S. Cl. ..... 211/59.2; 211/182

[58] Field of Search ..... 211/59.2, 151, 211/182; 312/35, 42

[56] References Cited

U.S. PATENT DOCUMENTS

| | | | |
|---|---|---|---|
| 4,790,707 | 12/1988 | Magretta et al. . | |
| 5,201,429 | 4/1993 | Hikosaka et al. | 211/59.2 |
| 5,405,023 | 4/1995 | Muakami | 211/59.2 X |
| 5,419,444 | 5/1995 | Strom | 211/59.2 X |
| 5,484,150 | 1/1996 | Yasutomi | 211/182 X |

*Primary Examiner*—Jose V. Chen
*Attorney, Agent, or Firm*—Lawrence J. Shurupoff

[57] ABSTRACT

A modular parts supply rack having a loading end and a delivery end, for supplying a plurality of containers filled with small parts to an assembly line operator at the delivery end and for return of empty containers to the loading end. Upper, intermediate and lower vertically spaced-apart horizontal support bars are adjustably connected to laterally spaced-apart upright bars at the loading end by T-shaped connectors. Upper, intermediate and lower vertically spaced-apart horizontal support bars are adjustably connected to laterally spaced-apart upright bars at the delivery end by T-shaped connectors. Laterally spaced pairs of slide bars are adjustably connected to the upper support bars, to the intermediate support bars, and to the lower support bars by T-shaped connectors. The support bars are positioned so that the upper and intermediate pairs of slide bars slope downwardly toward the delivery end, and the lower slide bars slope downwardly toward the loading end. All of the bars are of the same circular cross-section and diameter and all of the T-shaped connectors are of identical construction and interchangeable.

4 Claims, 2 Drawing Sheets

MODULAR PARTS SUPPLY RACK

FIELD OF INVENTION

This invention relates generally to supply racks and more particularly to a modular parts supply rack for supplying a plurality of containers filled with small parts to an assembly line operator.

BACKGROUND AND SUMMARY

Many small parts are used in the assembly of cars and tracks. The small parts are such things as fasteners (screws, bolts, screw nails, etc.), mechanical parts used in the construction of vehicles, and the like. These parts are supplied to assembly line operators at assembly work stations. They are normally provided in boxes or containers. The provision of containers of small parts at an assembly line work station enables an operator to remove production parts from the container and assemble the parts on a moving flow of vehicles or vehicle sub-assemblies.

In accordance with the present invention, a modular parts supply rack is provided for supplying a plurality of containers filled with small parts to a delivery station for use by assembly line operators. The supply rack is also provided with a means for returning empty containers from the delivery station back to a loading station. The rack includes a pair of laterally spaced-apart upright posts or bars at the loading end and a similar pair of upright posts or bars at the delivery end. Upper, intermediate and lower vertically spaced-apart horizontal support bars extend between the upright bars at the loading end, and similar upper, intermediate and lower vertically spaced-apart horizontal support bars extend between the upright bars at the delivery end. A pair of laterally spaced-apart slide bars extend between the upper support bars at the loading and delivery ends, between the intermediate support bars at the loading and delivery ends, and between the lower support bars at the loading and delivery ends. Preferably, the upper and intermediate loading end support bars are at a higher level than those at the delivery end so that containers supported on the upper and intermediate slide bars can move by gravity to the delivery end. The lower loading end support bars are at a lower level than the delivery end support bars so that empty containers may move by gravity along the lower slide bars back to the loading end where they may be re-filled with parts.

Fastening means are provided for slidably and releasably connecting the horizontal support bars to the upright bars and likewise for connecting the ends of the slide bars to the support bars. Preferably, all of the bars are of the same circular cross-section and diameter and all of the fastening means are of identical construction so that such fastening means are interchangeable.

Preferably, each fastening means is in the form of a T-shaped connector having an elongated tubular crossing member and a tubular stem extending from the midpoint of the crossing member perpendicular thereto. The tubular crossing members of the connectors are adapted to slidably receive the upright bars, and the ends of the support bars are adapted to be received in the stems thereof, so that the support bars may be adjusted vertically. Likewise, the tubular crossing members of the connectors are adapted to slidably receive the horizontal support bars, and the ends of the slide bars are adapted to be received in the stems thereof, so that the slide bars may be adjusted laterally on the support bars. Set screws are provided to releasably lock the crossing members of the connectors to the upright bars and to the horizontal support bars in adjusted position, and to releasably lock the stems of the connectors to the ends of the support bars and the ends of the slide bars.

One object of this invention is to provide a modular parts supply rack having the foregoing features and capabilities.

Another object is to provide a modular parts supply rack which is composed of a relatively few simple parts, the parts being largely interchangeable, which is rugged and durable in use, and is capable of being inexpensively manufactured and assembled.

These and other objects, features and advantages of the invention will become more apparent as the following description proceeds, especially when considered in conjunction with the accompanying drawings and claims.

DETAILED DESCRIPTION

Figure 1:
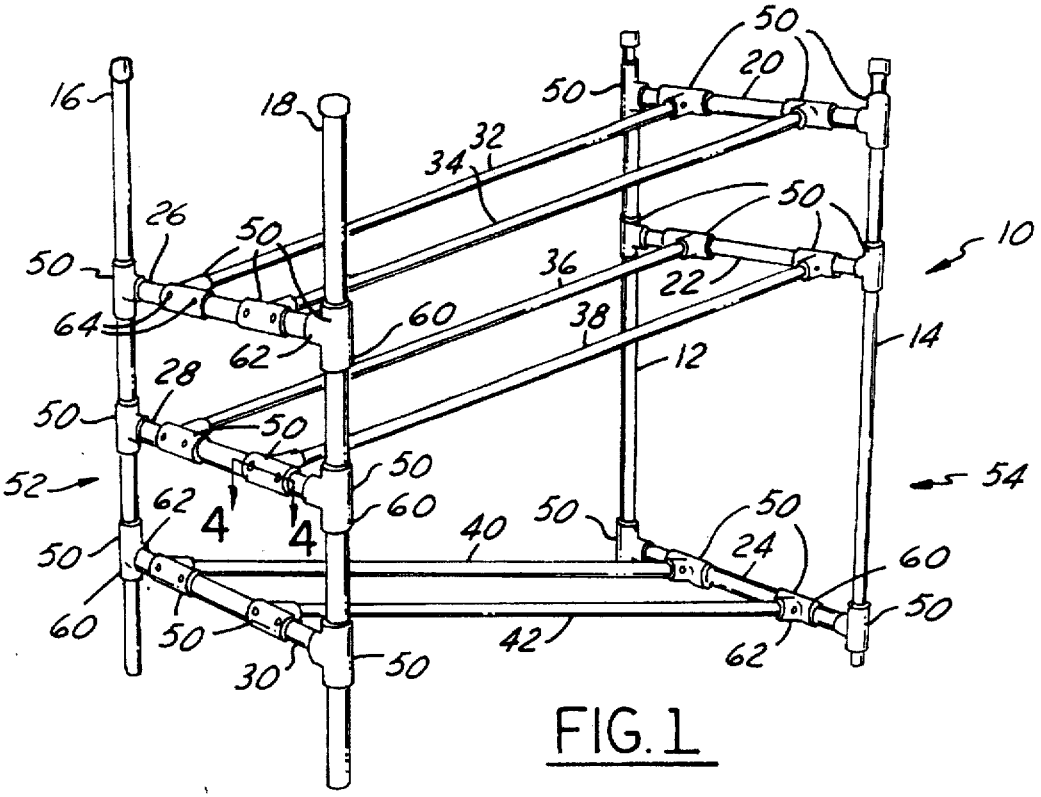
FIG. 1 is a perspective view of a modular parts supply rack constructed in accordance with the invention.

Referring now more particularly to the drawings, the supply rack 10 is made essentially of bar stock, preferably tubular bars of metal or plastic, including vertically extending, upright posts or bars 12, 14, 16 and 18, horizontal support bars 20, 22, 24, 26, 28 and 30, and slide bars 32, 34, 36, 38, 40 and 42. These bars are preferably all of the same diameter and of the same uniform circular cross-section throughout their length and are connected together by connectors 50. The rack is designed to deliver parts containers C to a delivery station at the delivery end 52 of the rack and return empty containers to a loading station at the loading end 54.

The upright bars 12 and 14 are laterally spaced apart at the loading end 54 of the rack. The upright bars 16 and 18 are laterally spaced apart at the delivery end 52 of the rack.

The upper horizontal support bar 20, intermediate horizontal support bar 22 and lower horizontal support bar 24 extend between the upright bars 12 and 14 at the loading end. The ends of these support bars are connected to the upright bars for vertical sliding adjustment by connectors 50. The upper horizontal support bar 26, the intermediate horizontal support bar 28, and the lower horizontal support bar 30 extend between the upright bars 16 and 18 at the delivery end. The ends of these support bars are connected to the upright bars for vertical sliding adjustment by connectors 50.

The upper slide bars 32 and 34 are laterally spaced apart and extend between the upper horizontal support bars 20 and 26. The ends of these slide bars are connected to the support bars 20 and 26 for lateral sliding adjustment by connectors 50. The intermediate slide bars 36 and 38 are laterally spaced apart and extend between the intermediate horizontal support bars 22 and 28. The ends of these slide bars are connected to the support bars 22 and 28 for lateral sliding adjustment by connectors 50. The lower slide bars 40 and 42 are laterally spaced apart and extend between the lower horizontal support bars 24 and 30. The ends of these slide bars are connected to the support bars 24 and 30 for lateral sliding adjustment by connectors 50. The pair of upper slide bars, the pair of intermediate slide bars, and the pair of lower slide bars are adjusted so as to be parallel to one another.

Figure 4:
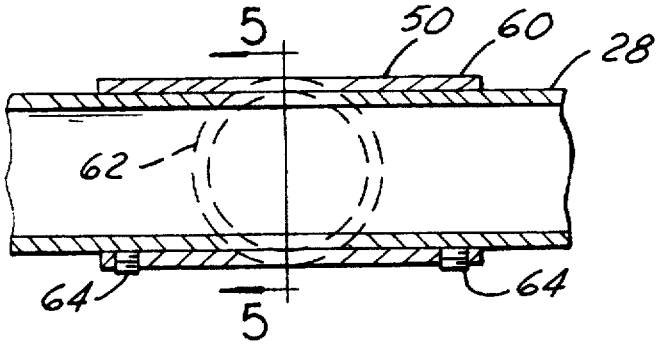
FIG. 4 is a sectional view taken on the line 4—4 in FIG. 1.
Figure 5:
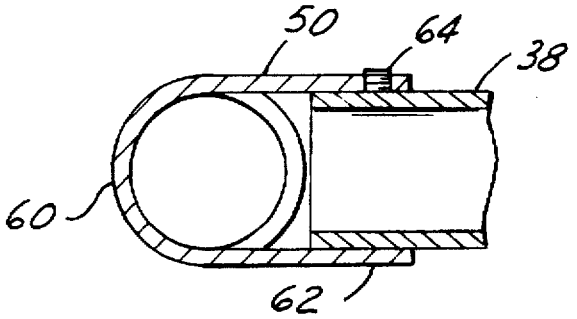
FIG. 5 is a sectional view taken on the line 5—5 in FIG. 4.

The connectors 50 for connecting the ends of the support bars 20–30 to the upright bars 12–18 and for connecting the ends of the slide bars 32–42 to the support bars are all of the same construction. As shown in FIGS. 4 and 5, each connector is generally T-shaped, having a tubular cross member 60 and a tubular stem 62 extending from the mid-point of the cross member perpendicular thereto. The cross members 60 and stems 62 are of the same internal diameter and of the same uniform internal circular cross section as the upright bars, support bars, and slide bars, so that the connectors are interchangeable and all such bars are capable of being slidably received therein. Set screws 64 are associated with the cross member 60 and with the stem 62 of each connector for locking the bar received therein in adjusted position.

Three connectors 50 are associated with each upright bar 12–18, with the cross member 60 of the connector slidably receiving the upright bar. The uppermost support bar 20 at the loading end 54 has its ends received in the stems 62 of the uppermost connectors on the upright bars 12 and 14. The uppermost support bar 26 at the delivery end 52 has its ends received in the stems 62 of the uppermost connectors on the upright bars 16 and 18.

The intermediate support bar 22 at the loading end 54 has its ends received in the stems 62 of the intermediate connectors on the upright bars 12 and 14. The intermediate support bar 28 at the delivery end 52 has its ends received in the stems 62 of the intermediate connectors on the upright bars 16 and 18.

The lowermost support bar 24 at the loading end 54 has its ends received in the stems 62 of the lowermost connectors on the upright bars 12 and 14. The lowermost support bar 30 at the delivery end 52 has its ends received in the stems 62 of the lowermost connectors on the upright bars 16 and 18.

The cross members 60 of the connectors 50 on each of the upright bars 12–18 are locked in adjusted position by set screws 64. The ends of the support bars 20–30 are locked in the stems 62 of the connectors on the upright bars 12–18 by set screws 64.

Two connectors 50 are associated with each of the horizontal support bars 20–30, with the cross member 60 of the connector slidably receiving the support bar. The connectors 50 associated with the support bars are for connecting the opposite ends of the slide bars thereto. Each of the uppermost slide bars 32 and 34 has its ends received in the stems 62 of a connector 50 on the uppermost support bar 20 and a connector 50 on the uppermost support bar 26. Each of the intermediate slide bars 36 and 38 has its ends received in the stems 62 of a connector 50 on the intermediate support bar 22 and a connector 50 on the intermediate support bar 28. Each of the lower slide bars 40 and 42 has its ends received in the stems 62 of a connector 50 on the lower support bar 24 and a connector 50 on the lower support bar 30.

The connectors 50 on the support bars 20–30 are locked in adjusted position along the length of the support bars by set screws 64 and the ends of the slide bars 32–42 are locked in the stems 62 of the connectors by set screws 64.

The rack will be set up with the slide bars at each level spaced apart and parallel to one another. The slide bars 32, 34 and 36, 38 at the upper and intermediate levels are sloped downwardly from the loading to the delivery end at a suitable angle, for example, about 15°, to the horizontal plane to provide an adequate gravity feed of filled containers C thereon. The lower pair of slide bars 40 and 42 slope downwardly in the opposite direction, that is, toward the loading end, for the gravity return of empty containers. The fact that the bottom pair of slide bars slopes in the opposite direction from the upper and intermediate slide bars has the added advantage of providing structural stability to the rack.

Figure 3:
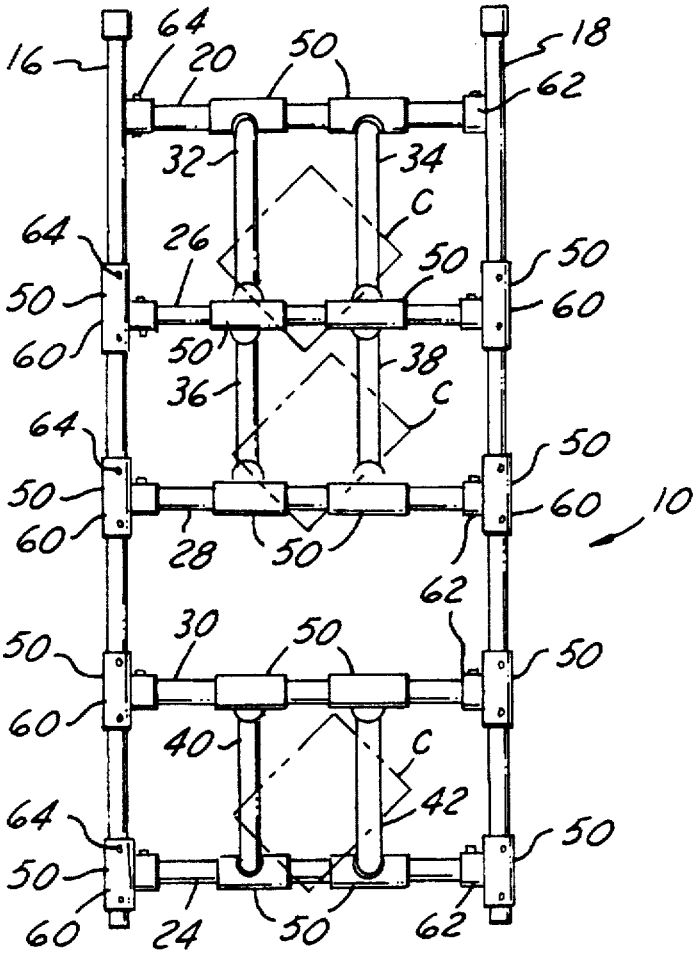
FIG. 3 is an end elevational view of the modular parts supply rack.

The containers C may be of any suitable construction and preferably are rectangular with vertical side walls extending upwardly from the base. A container has been developed recently by Automotive Industry Action Group. The container is preferably fabricated of a tough plastic material and is of a size which is suitable for the intended function. The container is open at the top, may be approximately 15" long, 8" wide, and 8" high. It may or may not have a hinged top which is open during use to provide access to the contents of the container. The container is wider than the space between the slide bars at each level so that, as seen in FIG. 3, the container may fit down between the two slide bars, with its bottom resting on one of the slide bars and a side wall resting on the other slide bar. The containers are preferably tilted to one side for the convenience of an operator positioned at that side of the rack.

The operator will take parts from the container on either the upper pair of slide bars or the intermediate pair of slide bars at the delivery end, and when empty the container will be transferred to the bottom pair of slide bars where it will return by gravity to the loading end and refilled. A line of filled containers is usually maintained on the pair of slide bars at both the upper and intermediate levels so that when an empty container at the delivery end is transferred to the bottom level, the following filled containers in the line will move by gravity to the delivery end.

Figure 2:
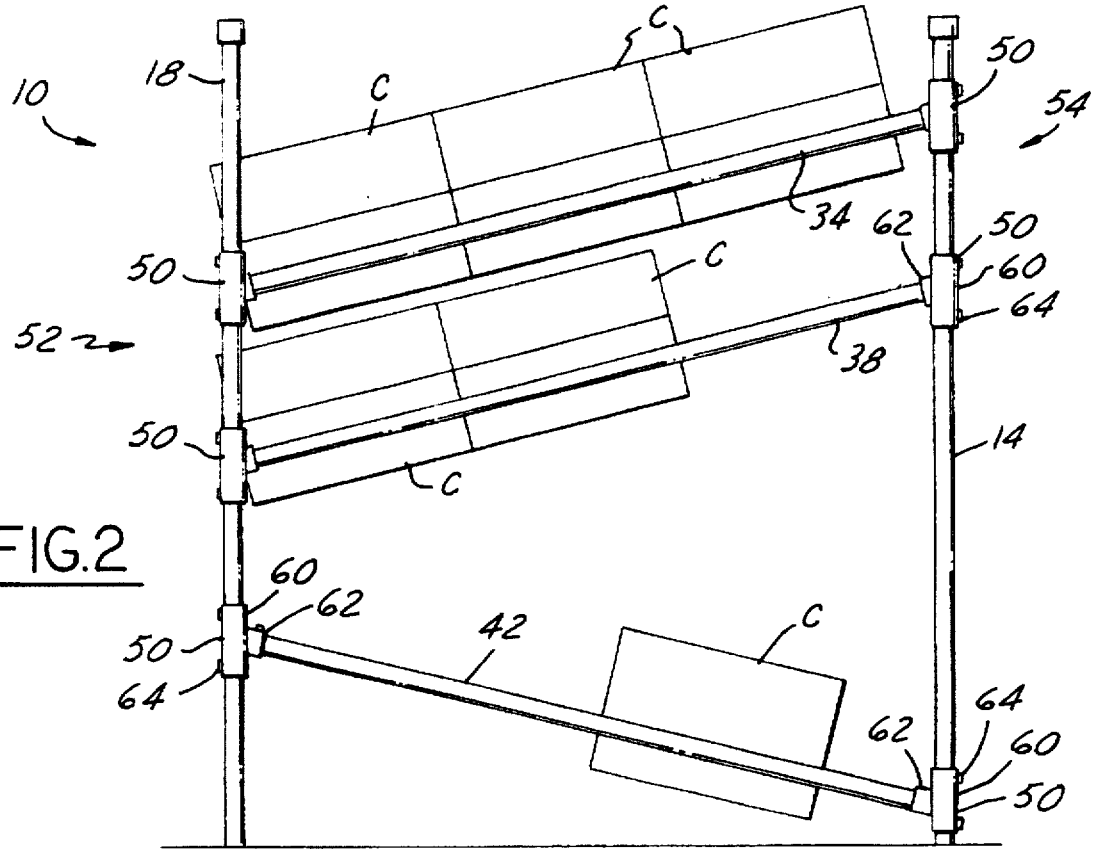
FIG. 2 is a side elevational view of the modular parts supply rack shown in FIG. 1.

As shown in FIG. 2, the upper and intermediate horizontal support bars 26, 28, at the delivery end, prevent the containers C from sliding off the delivery end and the lower horizontal support bar 24 at the loading end prevents the containers C from sliding off the loading end.

It is a simple matter to make an adjustment in the position of the support bars to vary the angle of slope of the slide bars, and to change the spacing of the slide bars at each level. It is also possible to provide two laterally spaced pairs of slide bars at each level, depending upon the overall width of the rack, so that two lines of containers may be provided at each level.

The connectors are all of the same construction and therefore are interchangeable. The support bars and upright bars, being of the same diameter and cross section can easily be replaced and longer or shorter bars may be substituted whenever needed or desired.

I claim:

1. A modular parts supply rack having a loading end and a delivery end spaced from the loading end, for supplying a plurality of containers filled with small parts from the loading end to the delivery end for use by an assembly line operator and for return of empty containers from the delivery end to the loading end, said rack comprising a pair of laterally spaced-apart loading end upright bars, a pair of laterally spaced-apart delivery end upright bars, upper, intermediate and lower vertically spaced apart loading end horizontal support bars extending between and having opposite ends adjacent said loading end upright bars, said upper and intermediate delivery end horizontal support bars preventing said containers from sliding off said delivery end of said supply rack, first fastening means adjustably connecting the opposite ends of said loading end support bars to said respective loading end upright bars, upper, intermediate and lower vertically spaced-apart delivery end horizontal support bars extending between and having opposite ends adjacent said delivery end upright bars, second fastening means adjustably connecting the opposite ends of said delivery end support bars to said respective delivery end upright bars, a pair of laterally spaced-apart upper slide bars extending between and having opposite ends adjacent said respective upper support bars, third fastening means adjustably connecting the opposite ends of said upper slide bars to said respective upper support bars, a pair of laterally spaced-apart intermediate slide bars extending between and having opposite ends adjacent said intermediate support bars, fourth fastening means adjustably connecting the opposite ends of said intermediate slide bars to said respective intermediate support bars, a pair of laterally spaced-apart lower slide bars extending between and having opposite ends adjacent said lower support bars, fifth fastening means connecting the opposite ends of the lower slide bars to said respective lower support bars, the upper and intermediate loading end support bars being at a higher level than the respective upper and intermediate delivery end support bars so that the slide bars connected thereto slope downwardly toward the delivery end, the lower loading end support bar being at a lower level than the lower delivery end support bar so that the slide bars connected thereto slope downwardly toward the loading end, all of said bars being of the same circular cross-section and diameter and all of said first, second, third, fourth and fifth fastening means being of identical construction and interchangeable.

2. A modular parts supply rack as defined in claim 1, wherein said identical fastening means consists of a plurality of identical T-shaped connectors each having an elongated tubular crossing member and a tubular stem extending from the midpoint in the length of the crossing member perpendicular thereto, the inside diameter of the crossing member and the tubular stem of each connector being of the same circular cross-section and diameter as that of the bars, said first and second fastening means comprising one such connector at each end of each said support bar having the stem thereof releasably receiving one such end of the support bar and having the crossing member thereof slidably and releasably receiving one of the upright bars, said third, fourth and fifth fastening means comprising one such connector at each end of each slide bar having the stem thereof releasably receiving one such end of the slide bar and having the crossing member thereof slidably and releasably receiving one of the horizontal support bars.

3. A modular parts supply rack as defined in claim 2, wherein the bar slidably received in each crossing member is releasably secured thereto by a set screw, and each bar end received in a stem of one such connector is releasably secured therein by a set screw.

4. The modular parts supply racks as defined in claim 1, wherein said lower loading end horizontal support bar prevents said containers from sliding off said loading end of said supply rack.

* * * * *